US011721468B2

(12) United States Patent
Lee et al.

(10) Patent No.: US 11,721,468 B2
(45) Date of Patent: Aug. 8, 2023

(54) COIL COMPONENT

(71) Applicant: SAMSUNG ELECTRO-MECHANICS CO., LTD., Suwon-si (KR)

(72) Inventors: Kwi Jong Lee, Suwon-si (KR); Jung Min Kim, Suwon-si (KR); Sung Jin Huh, Suwon-si (KR); Jin Hyuck Yang, Suwon-si (KR); Jae Wook Lee, Suwon-si (KR); Ji Hyun Eom, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 388 days.

(21) Appl. No.: 16/911,623

(22) Filed: Jun. 25, 2020

(65) Prior Publication Data

US 2021/0202148 A1 Jul. 1, 2021

(30) Foreign Application Priority Data

Dec. 30, 2019 (KR) ..... 10-2019-0178323

(51) Int. Cl.
*H01F 17/00* (2006.01)
*H01F 17/04* (2006.01)
(Continued)

(52) U.S. Cl.
CPC ..... *H01F 17/0013* (2013.01); *H01F 17/04* (2013.01); *H01F 27/2885* (2013.01); *H01F 27/32* (2013.01); *H01F 2017/048* (2013.01)

(58) Field of Classification Search
CPC ..... H01F 17/0013; H01F 17/04; H01F 27/29; H01F 27/2885; H01F 27/32; H01F 2017/048
See application file for complete search history.

(56) References Cited

U.S. PATENT DOCUMENTS 11,139,094 B2 * 10/2021 Park ..... H01F 27/32
2010/0302704 A1 * 12/2010 Ogawa ..... H01G 4/2325 361/306.3
(Continued)

FOREIGN PATENT DOCUMENTS

JP 6299868 B2 3/2018
KR 10-1580411 B1 12/2015
(Continued)

OTHER PUBLICATIONS

Office Action issued in corresponding Korean Patent Application No. 10-2019-0178323 dated Mar. 5, 2021, with English translation.

*Primary Examiner* — Hoa C Nguyen
(74) *Attorney, Agent, or Firm* — Morgan, Lewis & Bockius LLP

(57) ABSTRACT

A coil component includes a support substrate; a coil portion disposed on the support substrate; a body embedding the support substrate and the coil portion therein, and having a first surface and a second surface opposing each other, a third surface and a fourth surface opposing each other and respectively connecting the first and second surfaces; lead-out portions extending from the coil portion and respectively exposed from the third and fourth surfaces of the body; a surface-insulating layer disposed on the third and fourth surfaces of the body and having openings respectively exposing the lead-out portions; and external electrodes arranged on the surface-insulating layer and respectively connected to the lead-out portions respectively exposed through the openings, wherein a width of each of the external electrodes is narrower than a width of the body.

15 Claims, 6 Drawing Sheets

(51) Int. Cl.
*H01F 27/28* (2006.01)
*H01F 27/32* (2006.01)

(56) References Cited

U.S. PATENT DOCUMENTS

| | | | | |
|---|---|---|---|---|
| 2012/0274432 | A1* | 11/2012 | Jeong | H01F 27/2804 336/192 |
| 2015/0187487 | A1* | 7/2015 | Park | H01F 17/0013 336/192 |
| 2016/0086714 | A1 | 3/2016 | Moon et al. | |
| 2016/0268038 | A1 | 9/2016 | Choi | |
| 2017/0032887 | A1 | 2/2017 | Hamada et al. | |
| 2018/0137965 | A1* | 5/2018 | Lee | H01F 17/0033 |
| 2019/0326041 | A1* | 10/2019 | Kawaguchi | H01F 17/0013 |
| 2020/0365315 | A1* | 11/2020 | Kim | H01F 27/292 |
| 2021/0233698 | A1* | 7/2021 | Takahashi | H01F 41/041 |

FOREIGN PATENT DOCUMENTS

| | | | |
|---|---|---|---|
| KR | 10-2016-0108935 | A | 9/2016 |
| KR | 10-2018-0028374 | A | 3/2018 |
| KR | 10-2018-0054266 | A | 5/2018 |
| KR | 10-2019-0072243 | A | 6/2019 |
| KR | 10-2176276 | B1 | 11/2020 |

* cited by examiner

COIL COMPONENT

CROSS-REFERENCE TO RELATED APPLICATION(S)

This application claims the benefit of priority to Korean Patent Application No. 10-2019-0178323 filed on Dec. 30, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a typical passive electronic component used in electronic devices, along with a resistor and a capacitor.

In the case of a thin-film coil component, a coil portion may be formed by a plating process, a magnetic powder-resin composite in which a magnetic powder and a resin are mixed may be cured to prepare a body, and an external electrode may be formed outside the body, to manufacture the thin-film coil component.

However, when the body is prepared using the magnetic metal powder as described above, and the external electrode is formed on the outside of the body by the plating process, parasitic capacitance may occur between the coil portion and the external electrode.

SUMMARY

An aspect of the present disclosure is to reduce parasitic capacitance by adjusting a distance between a coil portion and an external electrode or a contact area between a body and an external electrode.

Another aspect of the present disclosure is to efficiently prevent reduction of a magnetic body volume of a body.

According to an aspect of the present disclosure, a coil component includes a support substrate; a coil portion disposed on the support substrate; a body embedding the support substrate and the coil portion therein, and having a first surface and a second surface opposing each other, a third surface and a fourth surface opposing each other and respectively connecting the first and second surfaces, and a fifth surface and a sixth surface opposing each other and respectively connecting the first to fourth surfaces; a first lead-out portion and a second lead-out portion, extending from the coil portion and respectively exposed from the third and fourth surfaces of the body; a surface-insulating layer disposed on the third and fourth surfaces of the body and having openings respectively exposing the first and second lead-out portions; and a first external electrode and a second external electrode, arranged on the surface-insulating layer and respectively connected to the first and second lead-out portions respectively exposed to the openings, wherein a width of each of the first and second external electrodes is narrower than a width of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
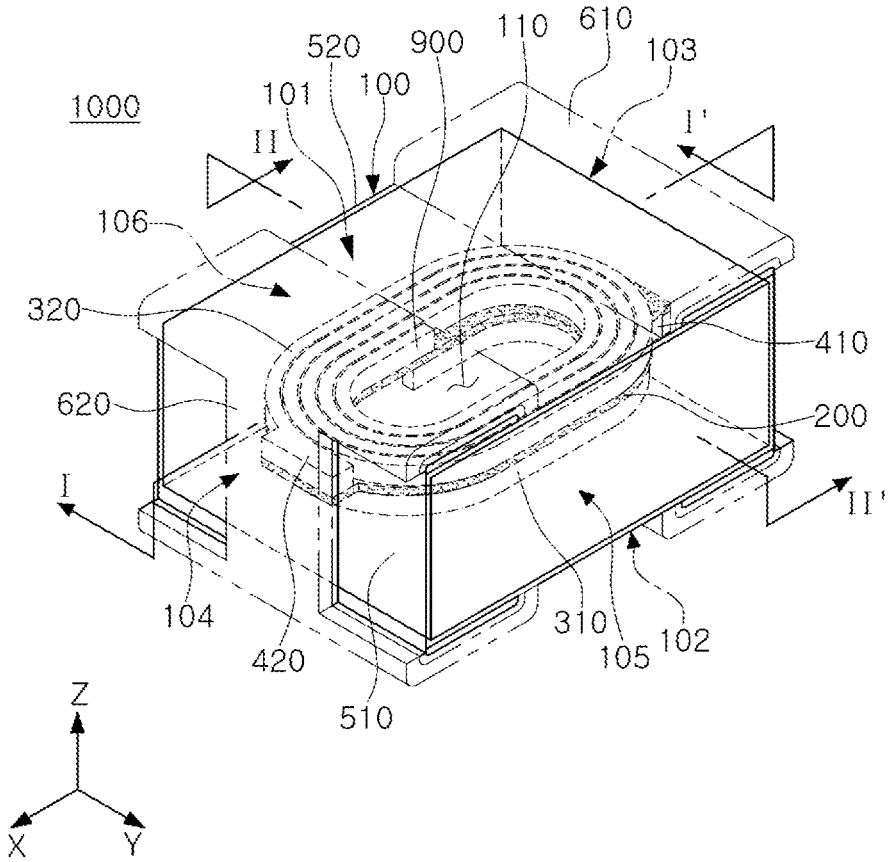
FIG. 1 is a view schematically illustrating a coil component according to a first embodiment of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after gaining an understanding of the disclosure of this application. Further, although the examples described herein have a variety of configurations, other configurations are possible as will be apparent after gaining an understanding of the disclosure of this application.

The drawings may not be to scale, and the relative size, proportions, and depiction of elements in the drawings may be exaggerated for clarity, illustration, and convenience.

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

In the drawings, the X direction may be defined as a first direction or a longitudinal direction, a Y direction as a second direction or a width direction, and a Z direction as a third direction or a thickness direction.

Hereinafter, a coil component according to an exemplary embodiment will be described in detail with reference to the accompanying drawings, and in describing with reference to the accompanying drawings, the same or corresponding components are assigned the same reference numbers, and overlapped descriptions thereof will be omitted.

Various types of electronic components are used in electronic devices, and various types of coil components may be appropriately used to remove noise between the electronic components.

For example, in electronic devices, coil components may be used as power inductors, high-frequency (HF) inductors, general beads, high-frequency beads (GHz Beads), and common mode filters.

Hereinafter, exemplary embodiments will be described on the premise that a coil component according to an exemplary embodiment is a power inductor used in a power line of a power supply circuit. However, the coil component according to an exemplary embodiment may be suitably applied as a chip bead, a chip filter, or the like as well as a power inductor.

First Embodiment

Figure 2:
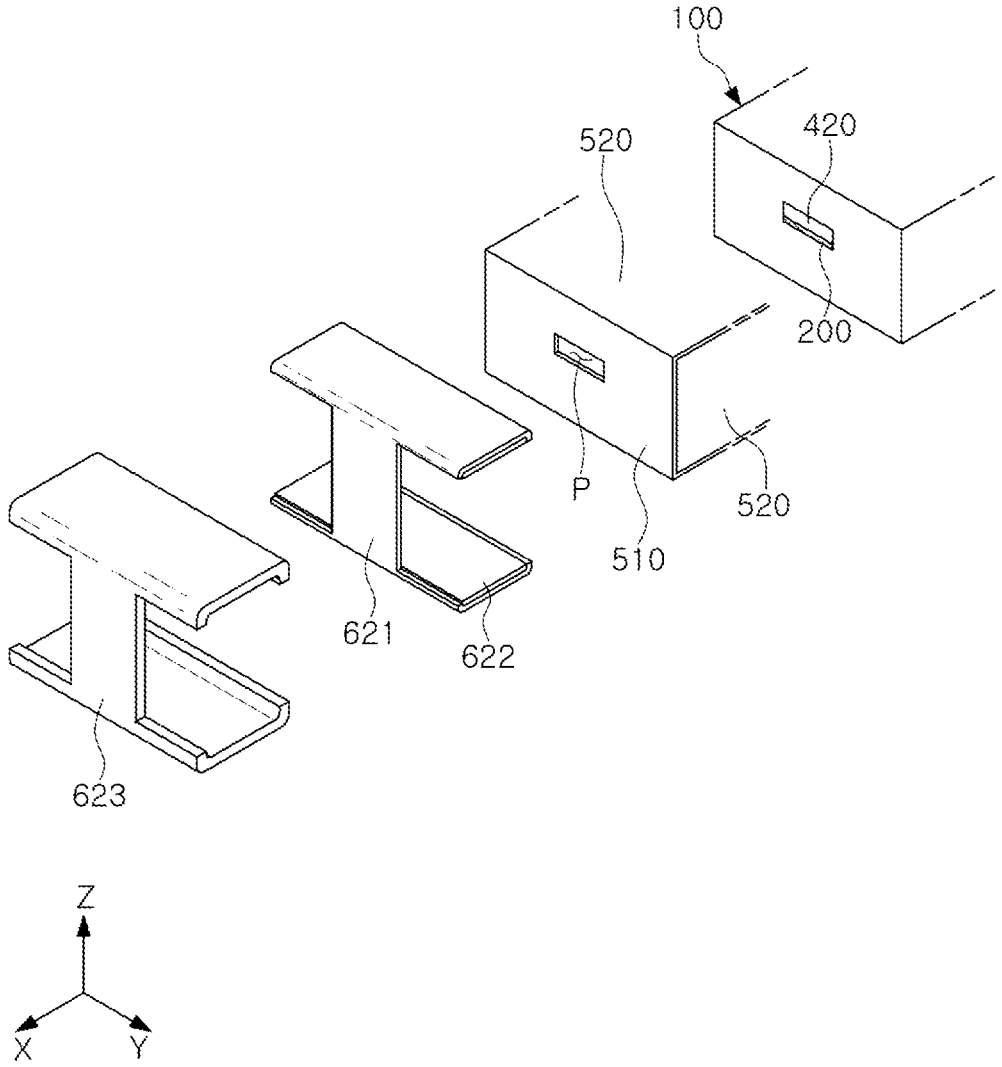
FIG. 2 is a view schematically illustrating a layout structure of a surface-insulating layer and an external electrode formed on the coil component of FIG. 1.
Figure 3:
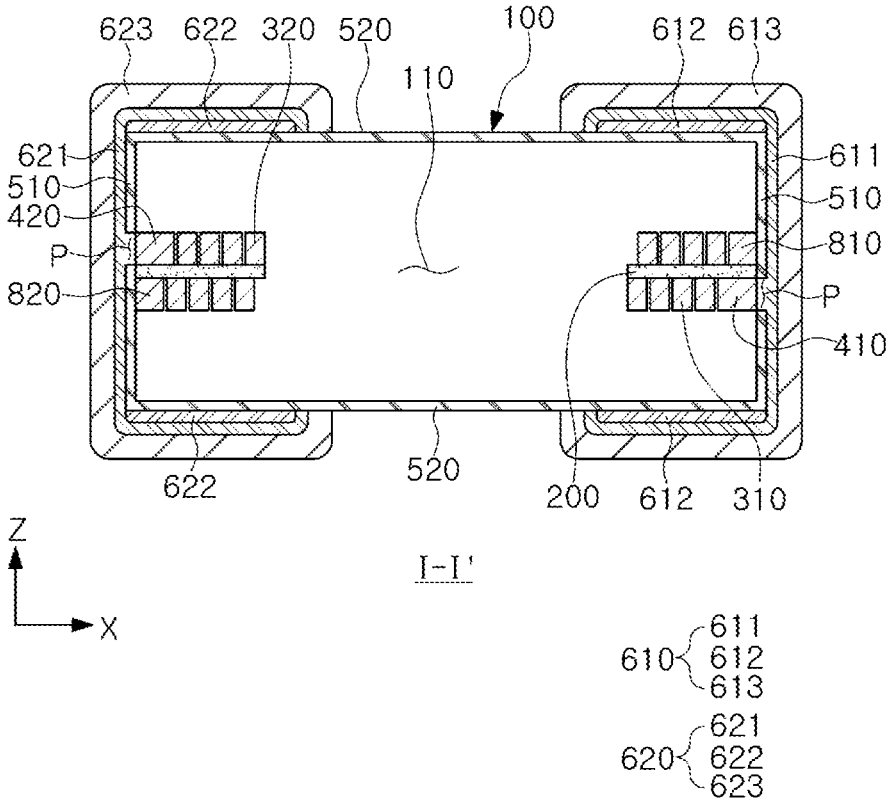
FIG. 3 is a cross-sectional view taken along line I-I' of FIG. 1.
Figure 4:
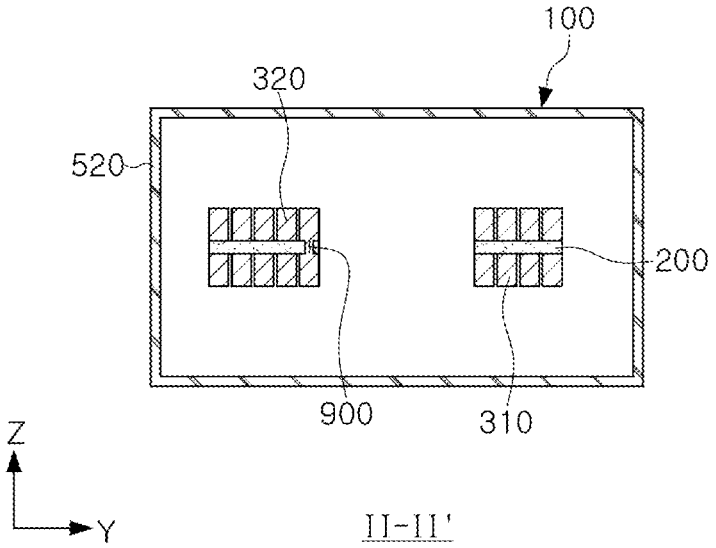
FIG. 4 is a cross-sectional view taken along line II-II' of FIG. 1.

FIG. 1 is a view schematically illustrating a coil component according to a first embodiment of the present disclosure. FIG. 2 is a view schematically illustrating a layout structure of a surface-insulating layer and an external electrode formed on the coil component of FIG. 1. FIG. 3 is a cross-sectional view taken along line I-I' of FIG. 1. FIG. 4 is a cross-sectional view taken along line II-II' of FIG. 1.

FIG. 1 mainly illustrates a body applied to a coil component according to a first embodiment of the present disclosure, and FIG. 2 mainly illustrates a surface-insulating layer and an external electrode applied to a coil component according to a first embodiment of the present disclosure.

Referring to FIGS. 1 to 4, a coil component 1000 according to a first embodiment of the present disclosure may include a body 100, a support substrate 200, first and second coil portions 310 and 320, first and second lead-out portions 410 and 410, a surface-insulating layer 500, first and second external electrodes 610 and 620, and first and second auxiliary lead-out portions 810 and 820.

The body 100 may form an exterior of the coil component 1000 according to this embodiment, and may embed the support substrate 200 and the first and second coil portions 310 and 320, described later, therein.

The body 100 may be formed to have a hexahedral shape overall.

Referring to FIG. 1, the body 100 may include a third surface 103 and a fourth surface 104 opposing each other in a length direction X, a first surface 101 and a second surface 102 opposing each other in a thickness direction Z, and a fifth surface 105 and a sixth surface 106 opposing each other in a width direction Y. Each of the first surface 101 and the second surface 102 of the body 100 opposing each other may connect the third surface 103 and the fourth surface 104 of the body 100 opposing each other. Each of the fifth surface 105 and the sixth surface 106 of the body 100 opposing each other may connect the first surface 101 to the fourth surface 104 of the body 100 opposing each other.

The body 100 may be formed such that the coil component 1000 according to this embodiment in which the external electrodes 610 and 620 to be described later are formed has a length of 2.0 mm, a width of 1.2 mm, and a thickness of 0.8 mm, a length of 1.6 mm, a width of 0.8 mm, and a thickness of 0.8 mm, or a length of 0.2 mm, a width of 0.25 mm, and a thickness of 0.4 mm, but is not limited thereto. Since the above-described numerical values do not take into account errors in the process, cases in which values are different from the above-mentioned values due to the errors in the process belong to the scope of the present disclosure.

The body 100 may include a magnetic material and a resin. Specifically, the body 100 may be formed by stacking at least one magnetic composite sheet including the resin and the magnetic material dispersed in the resin, and then curing the magnetic composite sheet. The body 100 may have a structure other than the structure in which the magnetic material may be dispersed in the resin. For example, the body 100 may be made of a magnetic material such as ferrite.

The magnetic material may be, for example, a ferrite powder particle or a magnetic metal powder particle.

Examples of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The magnetic metal powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic material may be amorphous or crystalline. For example, the magnetic metal powder particle may be a Fe—Si—B—Cr-based amorphous alloy powder, but is not limited thereto.

The ferrite powder and the magnetic metal powder particle may have an average diameter of about 0.1 μm to 30 μm, respectively, but are not limited thereto. The term "diameter" as used herein refers to the largest dimension of a given particle. The term "average diameter" as used herein refers to an average of the diameters of particles in a given amount of the magnetic metal powder.

The body 100 may include two or more types of magnetic materials dispersed in a resin. In this case, the term "different types of magnetic material" means that the magnetic materials dispersed in the resin are distinguished from each other by average diameter, composition, crystallinity, and a shape.

The resin may include an epoxy, a polyimide, a liquid crystal polymer, or the like, in a single form or in combined forms, but is not limited thereto.

The body 100 may include the first and second coil portions 310 and 320, and a core 110 passing through the support substrate 200 to be described later. The core 110 may be formed by filling the magnetic composite sheet with through-holes of the first and second coil portions 310 and 320, but is not limited thereto.

The support substrate 200 may be embedded in the body 100, and may include one surface and the other surface opposing each other. In this embodiment, the one surface of the support substrate 200 refers to a lower surface of the support substrate 200, and the other surface of the support substrate 200 refers to an upper surface of the support substrate 200, respectively.

The support substrate 200 may have a thickness of 10 μm or more and 60 μm or less.

The support substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the support substrate 200 may be formed of an insulating material such as prepreg, Ajinomoto Build-up Film (ABF), FR-4, a bismaleimide triazine (BT) film, a photoimageable dielectric (PID) film, and the like, but is not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide better rigidity. When the support substrate 200 is formed of an insulating material not containing glass fibers, the support substrate 200 may be advantageous for reducing a thickness of the overall coil portions 310 and 320. When the support substrate 200 is formed of an insulating material containing a photosensitive insulating resin, the number of processes for forming the first and second coil portions 310 and 320 may be reduced. Therefore, it may be advantageous in reducing production costs, and a fine via may be formed.

The first and second coil portions 310 and 320 may be disposed on the one surface and the other surface of the support substrate 200, with respect to the support substrate 200, respectively, and may express characteristics of the coil component. For example, when the coil component 1000 of this embodiment is used as a power inductor, the first and second coil portions 310 and 320 may function to stabilize the power supply of an electronic device by storing an electric field as a magnetic field and maintaining an output voltage.

Referring to FIGS. 1 to 4, each of the first coil portion 310 and the second coil portion 320 may have a planar spiral shape in which at least one turn is formed around the core 110. For example, the first coil portion 310 may form at least one turn about an axis of the core 110 on the one surface of the support substrate 200.

The first and second coil portions 310 and 320 may include a coil pattern having a planar spiral shape, and the first and second coil portions 310 and 320 arranged on both surfaces of the support substrate 200 opposing each other may be electrically connected to a via electrode 900 formed on the support substrate 200.

The first and second coil portions 310 and 320 and the via electrode 900 may be formed of a metal having excellent electrical conductivity, and, may be formed of, for example, silver (Ag), palladium (Pd), aluminum (Al), nickel (Ni), titanium (Ti), gold (Au), copper (Cu), platinum (Pt), alloys thereof, or the like.

The first and second lead-out portions 410 and 420 may extend from the coil portions 310 and 320, and may be exposed from the third and fourth surfaces 103 and 104, respectively, of the body 100. Referring to FIGS. 1 to 3, one end of the first coil portion 310 may extend onto the one surface of the support substrate 200 to form the first lead-out portion 410, and the first lead-out portion 410 may be exposed from the third surface 103 of the body 100. In addition, one end of the second coil portion 320 may extend onto the other surface of the support substrate 200 to form the second lead-out portion 420, and the second lead-out portion 420 may be exposed from the fourth surface 104 of the body 100.

The first and second auxiliary lead-out portions 810 and 820 may be arranged to correspond to the first and second lead-out portions 410 and 420 on the other surface and the one surface of the support substrate 200. Referring to FIG. 3, the first lead-out portion 410 may be disposed on the one surface of the support substrate 200, and the first auxiliary lead-out portion 810 may be disposed on the other surface of the support substrate 200. The second lead-out portion 420 may be disposed on the other surface of the support substrate 200, and the second auxiliary lead-out portion 820 may be disposed on the one surface of the support substrate 200. Although not illustrated in detail, a connecting via (not illustrated) connecting the first lead-out portion 410 and the first auxiliary lead-out portion 810 and a connecting via (not illustrated) connecting the second lead-out portion 420 and the second auxiliary lead-out portion 820 may be formed respectively. As a result, the first lead-out portion 410 and the first auxiliary lead-out portion 810, and the second lead-out portion 420 and the second auxiliary lead-out portion 820 may be electrically connected to each other.

The first auxiliary lead-out portion 810 may be disposed to correspond to the first lead-out portion 410 based on the support substrate 200, and the second auxiliary lead-out portion 820 may be disposed to correspond to the second lead-out portion 420 based on the support substrate 200. The first and second auxiliary lead-out portions 810 and 820 together with the first and second lead-out portions 410 and 420 may be exposed from a surface of the body 100. Therefore, the first and second external electrodes 610 and 620 may not only be formed on the exposed surfaces of the first and second lead-out portions 410 and 420, but also formed on the exposed surfaces of the first and second auxiliary lead-out portions 810 and 820. Therefore, an area of the surface of the body 100 in which metal bonding with the first and second external electrodes 610 and 620 occurs may be increased, to increase coupling force between the body 100 and the first and second external electrodes 610 and 620.

At least one of the coil portions 310 and 320, the via electrode 900, the lead-out portions 410 and 420, and the auxiliary lead-out portions 810 and 820 may include at least one conductive layer.

For example, when the first coil portion 310, the first lead-out portion 410, the first auxiliary lead-out portion 810, and the via electrode 900 are formed on the one surface of the support substrate 100 by a plating process, the first coil portion 310, the first lead-out portion 410, the first auxiliary lead-out portion 810, and the via electrode 900 may include a seed layer, such as an electroless plating layer or the like, and an electroplating layer, respectively. In this case, the electroplating layer may have a single layer structure or a multilayer structure. The electroplating layer of the multilayer structure may be formed as a conformal film structure in which one electroplating layer may be covered by the other electroplating layer, and may be only formed in a structure in which the other electroplating layer is stacked on one surface of anyone electroplating layer. In the above-described example, the seed layer of the first coil portion 310, the seed layer of the first lead-out portion 410, the seed layer of the first auxiliary lead-out portion 810, and the seed layer of the via electrode 900 may be integrally formed so as not to form a boundary therebetween, but are not limited thereto. In the above-described example, the electroplating layer of the first coil portion 310, the electroplating layer of the first lead-out portion 410, the electroplating layer of the first auxiliary lead-out portion 810, and the electroplating layer of the via electrode 900 may be integrally formed so as not to form a boundary therebetween, but are not limited thereto.

Each of the coil portions 310 and 320, the lead-out portions 410 and 420, the auxiliary lead-out portions 810 and 820, and the via electrode 900 may be formed of a conductive material such as copper (Cu), aluminum (Al), silver (Ag), tin (Sn), gold (Au), nickel (Ni), lead (Pb), titanium (Ti), or alloys thereof, but is not limited thereto.

The surface-insulating layer 500 may be disposed on a surface of the body 100, and may have an opening P exposing the first and second lead-out portions 410 and 420. The opening P may refer to a region in which the first and second lead-out portions 410 and 420 are exposed from the third surface 103 and the fourth surface 104 of the body 100 as described below.

Referring to FIGS. 1 and 3, the surface-insulating layer 500 may include a first surface-insulating layer 510 formed in a region, except for a region of the third surface 103 and the fourth surface 104 of the body 100 from which the first and second lead-out portions 410 and 420 are exposed, and a second surface-insulating layer 520 disposed on the first surface 101, the second surface 102, the fifth surface 105, and the sixth surface 106 of the body 100.

Referring to FIGS. 1 and 3, the second surface-insulating layer 520 may be formed to reach both end portions opposing each other on each of the first surface 101, the second surface 102, the fifth surface 105, and the sixth surface 106 of the body 100 in the length direction X.

The surface-insulating layer 500 may be formed of an insulating material. For example, the insulating material may be a thermosetting resin such as an epoxy resin, a thermoplastic resin such as polyimide, or a photosensitive resin, or a liquid crystal crystalline polymer (LCP), but is not limited thereto. For example, the surface-insulating layer 500 may be formed as a plating resist for plating the first and second external electrodes 610 and 620 which will be described later. In addition, the surface-insulating layer 500 may be formed by applying or printing the insulating material on the surface of the body 100. Therefore, the surface-insulating layer 500 may be formed in a region of the surface of the body 100, except for regions from which the first and second lead-out portions 410 and 420 are exposed. The surface-insulating layer 500 may be formed as a thin parylene film, and may be formed using various insulating materials such as silicon oxide film ($SiO_2$), silicon nitride film ($Si_3N_4$), silicon oxynitride film (SiON), or the like. When the surface-insulating layer 500 is formed with these materials using a variety of processes, such as a vapor deposition process. As a result, the surface-insulating layer 500 may be disposed to continuously cover the magnetic metal powder particles and the resin of the body 100 on a surface of the body 100.

Recently, as mobile communications speed increases, driving frequency of a coil component used in a mobile device may also increase. In order to use the coil component smoothly in a high frequency zone, there may be a need to reduce parasitic capacitance in the coil component. The parasitic capacitance in the coil component 1000 may be shorter, as the longer a distance between the coil portion 310 or 320 and the external electrode 610 or 620, or as the larger a contact area between the body 100 and the external electrode 610 or 620. In this embodiment, the surface-insulating layer 500 may be formed on a surface of the body 100, to increase the distance between the coil portion 310 or 320 and the external electrode 610 or 620. Therefore, parasitic capacitance generated between the coil portion 310 or 320 and the external electrode 610 or 620 may be minimized.

The first and second external electrodes 610 and 620 may be disposed on a surface of the body 100 to cover the first and second lead-out portions 410 and 420. For example, each of the first and second external electrodes 610 and 620 may be connected to each of the first and second lead-out portions 410 and 420 disposed on the surface-insulating layer 500, and may be exposed by the opening P.

Referring to FIGS. 1 to 3, since the first lead-out portion 410 is exposed from the third surface 103 of the body 100, the first external electrode 610 may be formed on the third surface 103 of the body 100 to contact the first lead-out portion 410. Since the second lead-out portion 420 is exposed from the fourth surface 104 of the body 100, the second external electrode 620 may be formed on the fourth surface 104 of the body 100 to contact the second lead-out portion 420. Although not specifically illustrated, a width of each of the first and second external electrodes 610 and 620 may be narrower than a width of the body 100. In this embodiment, the width of the body 100 may refer to a distance between the fifth surface 105 and the sixth surface 106 of the body 100 opposing each other, for example, a distance in the width direction Y. Referring to FIG. 1, since a width of each of the first and second external electrodes 610 and 620 refers to a distance between the fifth surface 105 and the sixth surface 106 of the body 100 on the third surface 103 and the fourth surface 104 of the body 100, the width of each of the first and second external electrodes 610 and 620 may be narrower than a width of the body 100. As described above, parasitic capacitance in the coil component 1000 may increase, as a contact area between the body 100 and the external electrodes 610 and 620 increases. In this embodiment, a contact area between the body 100 and the external electrodes 610 and 620 on the first surface 101 and the second surface 102 may be reduced to minimize parasitic capacitance generated between the body 100 and the external electrodes 610 and 620.

Referring to FIG. 3, each of the first and second external electrodes 610 and 620 may include first metal layers 611 and 621 directly contacting the first and second lead-out portions 410 and 420 and filling the opening P. Referring to FIG. 2, a width of the first metal layer 611 formed on the third surface 103 and a width of the first metal layer 621 formed on the fourth surface 104 may be respectively narrower than the width of the body 100. In addition, on the third surface 103 and the fourth surface 104 of the body 100, the widths of the first metal layers 611 and 621 may correspond to the widths of the first and second lead-out portions 410 and 420, respectively. As described above, parasitic capacitance in the coil component 1000 may increase, as a contact area between the body 100 and the external electrodes 610 and 620 increases. In this embodiment, to the extent that electrical connectivity between the first metal layers 611 and 621 and the first and second lead-out portions 410 and 420 is secured, a contact area between the body 100 and the external electrodes 610 and 620 on the third surface 103 and the fourth surface 104 may be reduced to minimize parasitic capacitance generated between the body 100 and the external electrodes 610 and 620.

Since the first metal layers 611 and 621 may be formed directly on a surface of the body 100 by a plating process, the first metal layers 611 and 621 may be made of metal. The first metal layers 611 and 621 may be a copper (Cu) metal layer having excellent electrical conductivity and relatively low material cost, but are not necessarily limited thereto. Since the first metal layers 611 and 621 may be formed by a plating process, they may not include a glass component or a resin. Typically, when the body 100 is manufactured by curing a magnetic metal powder-resin composite, the external electrodes 610 and 620 may be formed by using a conductive resin paste including a conductive metal and a resin. In this case, the conductive metal included in the conductive resin paste may mainly use silver (Ag) having a relatively low specific resistance. Since the silver (Ag) has a relatively high material cost and frequent contact failure between the silver (Ag) and the coil portions 310 and 320, contact resistance may be excessively increased. In this embodiment, since the first metal layers 611 and 621 are directly formed on the surface of the body 100, poor contact between the coil portions 310 and 320 and the external electrodes 610 and 620 may be prevented. In addition, when the external electrodes 610 and 620 are formed using the conductive resin paste, it may be difficult to control the coating thickness of the conductive resin paste such that the external electrodes 610 and 620 may be formed thick, to increase a volume of the body 100. This decreasing problem exists. Since the external electrodes 610 and 620 of this embodiment may be formed by plating metal on a surface of the body 100, thicknesses of the external electrodes 610 and 620 may be adjusted to be thinner. Therefore, a volume of the body 100 may be increased, and inductance characteristics of the coil component in total may be improved.

Referring to FIG. 3, the first and second external electrodes 610 and 620 may further include conductive resin layers 612 and 622 respectively disposed on the first surface 101 or the second surface 102 of the body 100 and formed between the first metal layers 611 and 621. The conductive resin layers 612 and 622 may include one or more conductive metals selected from the group consisting of copper (Cu), nickel (Ni), and silver (Ag), and a thermosetting resin. The conductive resin layers 612 and 622 may be formed by applying and curing a conductive paste containing a conductive metal such as silver (Ag) or the like and a resin. Referring to FIG. 3, the conductive resin layers 612 and 622 may extend onto the first surface 101 or the second surface 102 of the body 100 to be arranged between the second surface-insulating layer 520 and the first metal layers 611 and 621. Although not specifically illustrated, the surface-insulating layer 500 may be formed on the first surface 101 or the second surface 102 of the body 100 as a plating resist, such that the first metal layers 611 and 621 may cover only a portion of the conductive resin layers 612 and 622. The body 100 and the conductive resin layers 612 and 622 may include an epoxy resin. The thermosetting resin included in the body 100 and the conductive resin layers 612 and 622 may be formed of the same thermosetting resin, for example, an epoxy resin, to improve fixing strength between the body 100 and the external electrodes 610 and 620.

Each of the first and second external electrodes 610 and 620 may further include second metal layers 613 and 623 disposed on the first metal layers 611 and 621 and made of a different metal from the first metal layers 611 and 621. Referring to FIG. 2, a width of the second metal layer 613 formed to cover the third surface 103 and a width of the second metal layer 623 formed to cover the fourth surface 104 may be respectively narrower than the width of the body 100. In addition, the widths of the second metal layers 613 and 623 formed on the third surface 103 and the fourth surface 104 of the body 100 may correspond to the widths of the first and second lead-out portions 410 and 420 to cover the first and second lead-out portions 410 and 420, respectively. In this embodiment, to the extent that electrical connectivity between the second metal layers 613 and 623 and the first and second lead-out portions 410 and 420 is secured, a contact area between the body 100 and the external electrodes 610 and 620 on the third surface 103 and the fourth surface 104 may be reduced to minimize parasitic capacitance generated between the body 100 and the external electrodes 610 and 620. The second metal layers 613 and 623 may sequentially include a first layer (not illustrated) including nickel (Ni) or a second layer (not illustrated) including tin (Sn). The second layer (not illustrated), which may be an outermost layer of the external electrodes 610 and 620, may be formed as a tin (Sn) plating layer, to improve adhesion to solder, when the coil component 1000 is mounted on a printed circuit board. In addition, the first layer (not illustrated) may be formed as a nickel (Ni) plating layer to improve connection between the first metal layers 611 and 621 made as a copper (Cu) plating layer and a second layer (not illustrated) made as a tin (Sn) plating layer.

Second Embodiment

Figure 5:
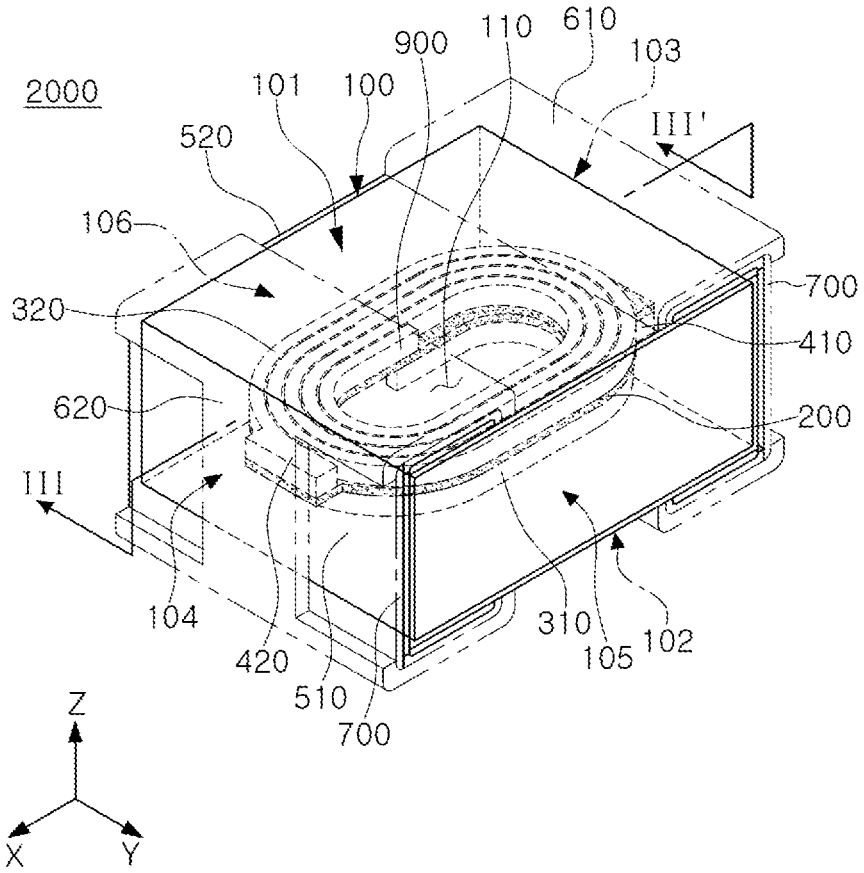
FIG. 5 is a view schematically illustrating a coil component according to a second embodiment of the present disclosure.
Figure 6:
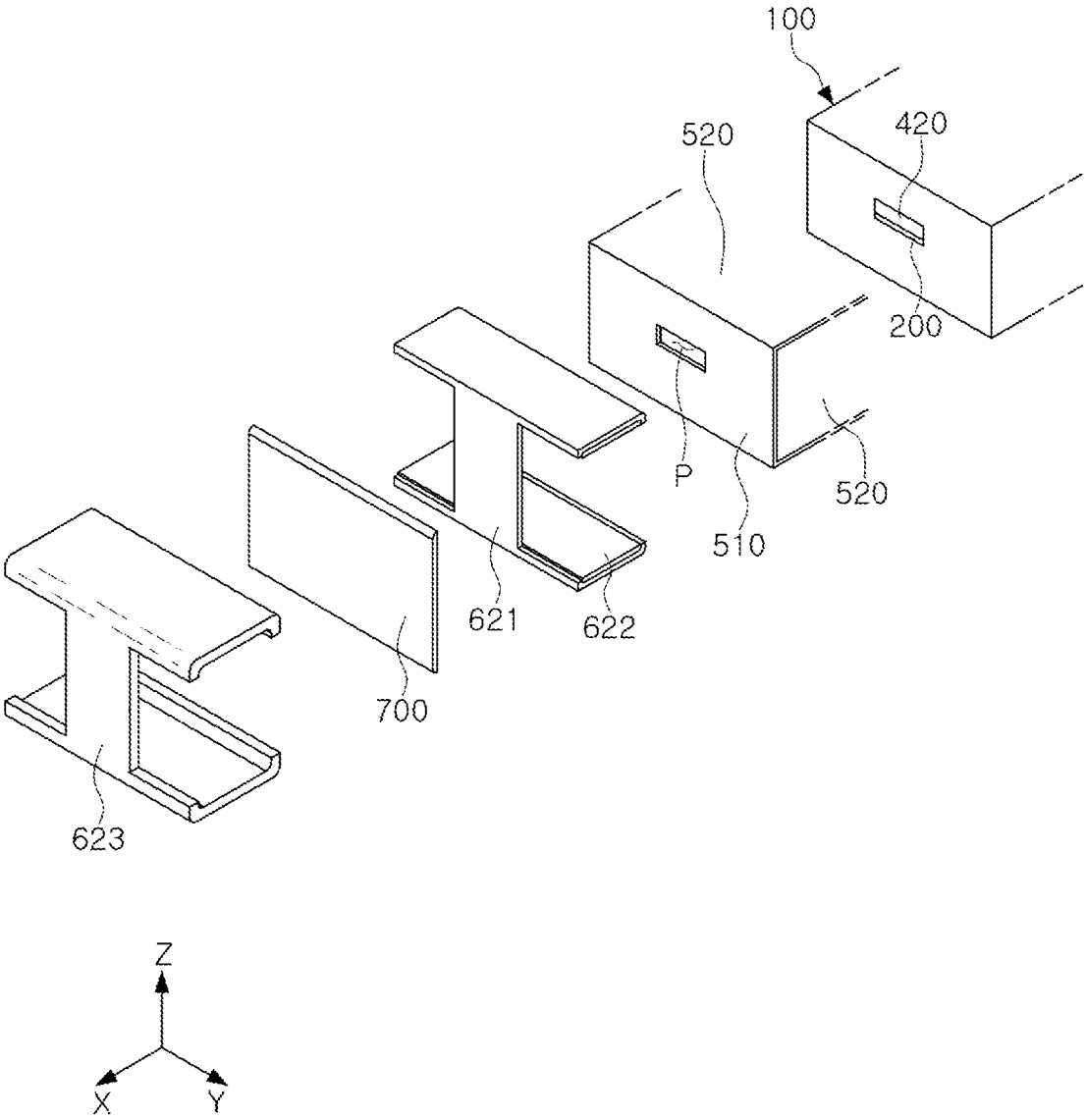
FIG. 6 is a view schematically illustrating a layout structure of a surface-insulating layer, an external electrode, and an additional insulating layer formed on the coil component of FIG. 5.
Figure 7:
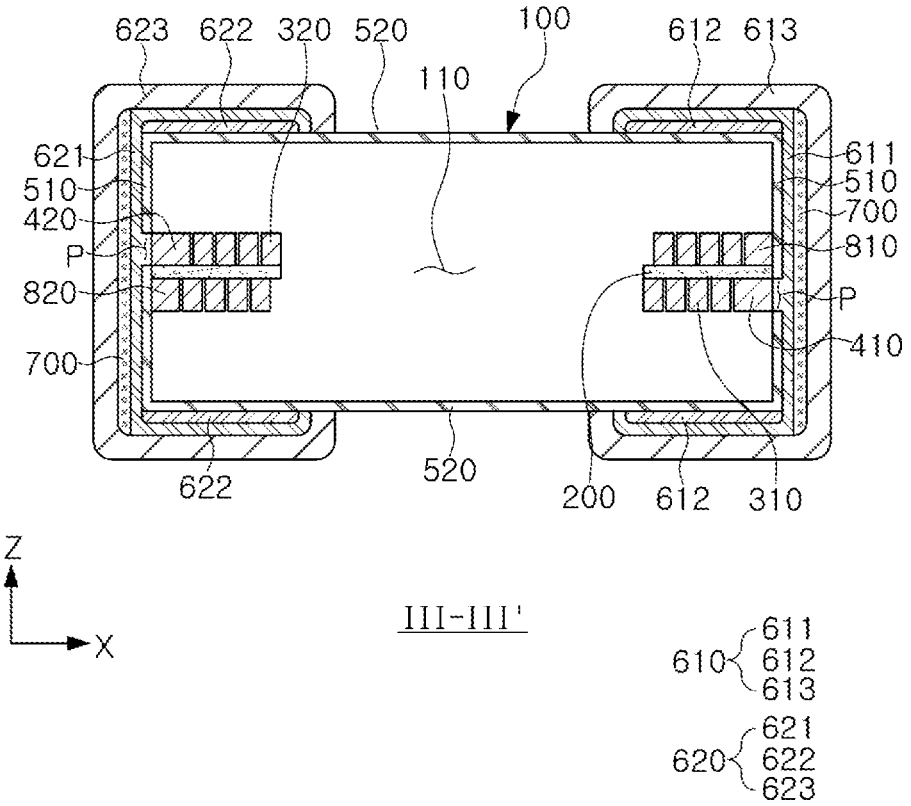
FIG. 7 is a cross-sectional view taken along line III-III' of FIG. 5.

FIG. 5 is a view schematically illustrating a coil component according to a second embodiment of the present disclosure. FIG. 6 is a view schematically illustrating a layout structure of a surface-insulating layer, an external electrode, and an additional insulating layer formed on the coil component of FIG. 5. FIG. 7 is a cross-sectional view taken along line of FIG. 5.

FIG. 5 mainly illustrates a body applied to a coil component according to a second embodiment of the present disclosure, and FIG. 6 mainly illustrates a surface-insulating layer, an external electrode, and an additional insulating layer, applied to a coil component according to a second embodiment of the present disclosure.

A coil component 2000 according to this embodiment may further include an additional insulating layer 700, compared to the coil component 1000 according to the first embodiment of the present disclosure. Therefore, only the additional insulating layer 700 different from the first embodiment will be described in describing this embodiment. The remaining configuration of this embodiment may be applied as it is in the first embodiment of the present disclosure.

Referring to FIGS. 5 to 7, a coil component 2000 of this embodiment may further include an additional insulating layer 700 respectively disposed on first metal layers 611 and 621. The additional insulating layer 700 may be respectively interposed between the first metal layers 611 and 621 and second metal layers 612 and 622. A width of the additional insulating layer 700 may be equal to a width of a body 100. As described above, parasitic capacitance in the coil component may increase, as a distance between coil portions 310 and 320 and external electrodes 610 and 620 is shorter. In this embodiment, the additional insulating layer 700 may be further disposed on third and fourth surfaces 103 and 104 of the body 100, to increase a distance between the coil portions 310 and 320 and the external electrodes 610 and 620. Therefore, parasitic capacitance generated between the coil portions 310 and 320 and the external electrodes 610 and 620 may be minimized.

Referring to FIG. 6, a width of the first metal layers 611 and 621 and a width of the second metal layers 613 and 623 may be respectively narrower than a width of the additional insulating layer 700. For example, the second metal layers 613 and 623 may be electrically connected to first and second lead-out portions 410 and 420 through the first metal layers 611 and 621 and first and second conductive resin layers 612 and 622, respectively. To the extent that electrical connectivity between the first metal layers 611 and 621 and the first and second lead-out portions 410 and 420 is secured, a contact area between the body 100 and the first metal layers 611 and 621 on the third surface 103 and the fourth surface 104 may be reduced to minimize parasitic capacitance generated between the body 100 and the external electrodes 610 and 620.

The present disclosure is not limited by the above-described embodiment and the accompanying drawings, but is intended to be limited by the appended claims.

Therefore, various forms of substitution, modification, and alteration may be made by those skilled in the art without departing from the technical spirit of the present disclosure described in the claims, which may be also within the scope of the present disclosure.

According to the present disclosure, parasitic capacitance may be reduced by adjusting a distance between a coil portion and an external electrode or a contact area between a body and an external electrode.

In addition, according to the present disclosure, reduction of a magnetic body volume of a body may be effectively prevented.

While example embodiments have been illustrated and described above, it will be apparent to those skilled in the art that modifications and variations could be made without departing from the scope of the present disclosure as defined by the appended claims.

What is claimed is:

1. A coil component comprising:

a support substrate;

a coil portion disposed on the support substrate;

a body embedding the support substrate and the coil portion therein, and having a first surface and a second surface opposing each other, a third surface and a fourth surface opposing each other and respectively connecting the first and second surfaces, and a fifth surface and a sixth surface opposing each other and respectively connecting the first to fourth surfaces;

a first lead-out portion and a second lead-out portion, extending from the coil portion and respectively exposed from the third and fourth surfaces of the body;

a surface-insulating layer disposed on the third and fourth surfaces of the body and having openings respectively exposing the first and second lead-out portions; and a first external electrode and a second external electrode, arranged on the surface-insulating layer and respectively connected to the first and second lead-out portions respectively exposed through the openings, wherein the first and second external electrodes comprise a first portion disposed on the surface-insulating layer along the third and fourth surfaces of the body, and a second portion disposed along the first and second surfaces of the body, a width of the first portion is narrower than a width of the body, and a width of the second portion is equal to the width of the body.

2. The coil component according to claim 1, wherein the surface-insulating layer is further disposed on the first and second surfaces of the body and the fifth and sixth surfaces of the body, and the surface-insulating layer is formed to reach both end portions opposing each other on each of the first and second surfaces of the body and the fifth and sixth surfaces of the body in a length direction.

3. The coil component according to claim 1, wherein the widths of the first and second external electrodes corresponds to widths of the first and second lead-out portions.

4. The coil component according to claim 1, wherein the body comprises a magnetic metal powder particle and a resin, wherein the surface-insulating layer is disposed to continuously cover the magnetic metal powder particle and the resin of the body on a surface of the body.

5. The coil component comprising:

a support substrate;

a coil portion disposed on the support substrate;

a body embedding the support substrate and the coil portion therein, and having a first surface and a second surface opposing each other, a third surface and a fourth surface opposing each other and respectively connecting the first and second surfaces, and a fifth surface and a sixth surface opposing each other and respectively connecting the first to fourth surfaces;

a first lead-out portion and a second lead-out portion, extending from the coil portion and respectively exposed from the third and fourth surfaces of the body;

a surface-insulating layer disposed on the third and fourth surfaces of the body and having openings respectively exposing the first and second lead-out portions; and a first external electrode and a second external electrode, arranged on the surface-insulating layer and respectively connected to the first and second lead-out portions respectively exposed through the openings, wherein a width of a portion of each of the first and second external electrodes is narrower than a width of the body, the surface-insulating layer is further disposed on the first and second surfaces of the body and the fifth and sixth surfaces of the body, the surface-insulating layer is formed to reach both end portions opposing each other on each of the first and second surfaces of the body and the fifth and sixth surfaces of the body in a length direction, and each of the first and second external electrodes further comprises a first metal layer in direct contact with the first and second lead-out portions, and a conductive resin layer disposed on one surface of the body and disposed between the surface-insulating layer and the first metal layer.

6. The coil component according to claim 5, wherein the first metal layer fills the opening.

7. The coil component according to claim 5, wherein the first metal layer is formed of copper (Cu).

8. The coil component according to claim 5, wherein each of the first and second external electrodes further comprises a second metal layer disposed on the first metal layer and formed of a metal different from the first metal layer.

9. The coil component according to claim 8, further comprising an additional insulating layer disposed on the first metal layer, wherein the additional insulating layer is interposed between the first metal layer and the second metal layer.

10. The coil component according to claim 9, wherein a width of the additional insulating layer is equal to a width of the body.

11. The coil component according to claim 9, wherein a width of each of the first and second metal layers is less than a width of the additional insulating layer.

12. A coil component comprising:

a coil portion disposed on a support substrate, and having a least one turn and first and second lead-out portions at opposite ends thereof;

a body enclosing the coil portion, and having a surface-insulating layer disposed on each of a pair of end surfaces of the body opposing each other in a length direction, the surface-insulating layer having openings through which the first and second lead-out portions of the coil portion are exposed; and first and second external electrodes disposed on the surface-insulating layer of a corresponding of the opposite end surfaces, and respectively contacting the first and second lead-out portions through the openings, a first portion of each of the first and second external electrodes having a width narrower than a width of a corresponding end surface, wherein each of the first and second external electrodes comprises a metal layer directly contacting a corresponding of the first and second lead-out portions, wherein a second portion of each of the first and second external electrodes extends on to top and bottom surfaces of the body opposing each other in a thickness direction, and wherein the second portion of the first and second external electrodes has a width equal to that of the corresponding of the top and bottom surfaces.

13. The coil component according to claim 12, wherein each of the top and bottom surfaces have a surface-insulating layer disposed thereon between the second portion of the first and second external electrodes.

14. The coil component according to claim 12, wherein the openings have a length and a width respectively smaller than a length and a width of the end surfaces, and the width of the first and second external electrodes is greater than the width of the corresponding openings.

15. The coil component according to claim 12, wherein a width of the openings is equal to a width of the first and second lead-out portions.

* * * * *